US005288241A

United States Patent [19]

Davidge et al.

[11] Patent Number: 5,288,241

[45] Date of Patent: Feb. 22, 1994

[54] CABLE LOCKING COVERS

[75] Inventors: Ronald V. Davidge, Coral Springs; John R. Dewitt, Boca Raton; Paul J. Galinis, Boynton Beach; Francis A. Kuchar, Jr., Delray Beach; Jay H. Neer; Thomas H. Newson, both of Boca Raton, all of Fla.

[73] Assignee: International Business Machines Corp., Armonk, N.Y.

[21] Appl. No.: 990,205

[22] Filed: Jun. 7, 1993

Related U.S. Application Data

[62] Division of Ser. No. 762,141, Sep. 19, 1991, Pat. No. 5,190,465.

[51] Int. Cl.[5] ..... H01R 13/62

[52] U.S. Cl. ..... 439/304; 439/372; 439/133; 70/57

[58] Field of Search ..... 439/367, 368, 484, 133, 439/134, 304, 372, 362; 70/57, 58, 163

[56] References Cited

U.S. PATENT DOCUMENTS 2,724,094 11/1955 Lewis ..... 439/372
4,479,688 10/1984 Jennings ..... 439/133
4,556,270 12/1985 Schützle et al. ..... 439/372
4,669,281 6/1987 Young ..... 70/57

*Primary Examiner*—Larry I. Schwartz
*Assistant Examiner*—Hien D. Vu
*Attorney, Agent, or Firm*—Richard A. Tomlin; Ronald V. Davidge

[57] ABSTRACT

Cover assemblies, capable of being locked and unlocked by means of a key, are configured to be placed over the connectors at each end of an external computer system cable. When these cover assemblies are locked in place, the cable cannot be unplugged from the connector ports of the system devices. When these cover assemblies are unlocked, they can be removed from the cable, and the cable can then be unplugged from the connector ports.

A first type of cover assembly is designed to operate with a connector which is fastened in place in its plugged position by means of a pair of screws, while a second type of cover assembly is designed to operate with a connector which is fastened in place by means of a pair of rotatable wire bails. These cover assemblies may also be used to prevent access to connector ports to which cables are not attached by locking in place terminators commonly used on such ports, or by locking in place shells configured for this purpose, if such terminators are otherwise not required.

2 Claims, 5 Drawing Sheets

CABLE LOCKING COVERS

CROSS-REFERENCE TO A RELATED APPLICATION

This application is a division of a prior application, Ser. No. 762,141, filed Sep. 19, 1991 now U.S. Pat. No. 5,190,461.

BACKGROUND OF THE INVENTION

1. Field of the Invention

This invention relates to providing data security by preventing access to the circuits extending from a unit.

2. Description of the Related Art

U.S. Pat. No. 4,669,281 (Young) shows a system in which data security is achieved by locking a cover in place over a locking structure attached to a connector. The connector is of a type which has two faces oriented in opposite directions, one of which can be attached to another cable while the other is attached to a system unit. A number of electrical contacts in the two faces are wired to each other and to wires in a cable extending from the body of the connector between the two faces. After the cable is attached to the system unit by means of a first pair of screws extending through the connector, with the first connector face plugged into an external port of the system unit, the locking structure is fastened over the second connector face with a second pair of screws operating in threaded holes in the first pair of screws. Then a cover is slid over the locking structure and locked in place.

The Young reference discloses a device which can only be used with the unusual type of connector described above. The device described in the present invention is configured for use with more common kinds of connectors having a wire cable extending from the body of the connector in a direction opposite to that of a single face having electrical contacts. While in the device disclosed in the Young reference the locking structure and cover are fastened in place over the second connector face, in the configurations described in the present application, the locking structure and cover are fastened in place over the cable extending from the connector. The Young reference disclosed device requires that the locking structure must be fastened in place by additional screws before the cover is installed, both of the configurations described herein use the hardware provided to hold the connector in place on the system unit for this purpose. In 15 the first embodiment described in this application, this function is provided by slipping a pair of slotted tabs under the heads of screws otherwise used to hold the connector in place. In the second embodiment this function is provided by a pair of tabs operating under a pair of rotatable bails otherwise used to hold the connector in place.

Our application Ser. No. 762,142, filed concurrently herewith and having a common assignee and entitled "Means for Locking Cables and Connector Ports" describes modifications to devices and to cable assemblies to allow the locking of the cables to the devices by means of the locking mechanisms holding the device covers in place. The invention described herein may be used as an optional upgrade, i.e. the locking covers of this invention can be installed on a system, without modification to the system or its cable assemblies.

Our application Ser. No. 762,138, filed concurrently herewith and assigned to the same assignee as this application and entitled "Device-port Locking Covers" describes locking covers configured to be used on unused external device ports where a terminator (a connector wherein certain contacts are interconnected contacts) is not required. The invention described herein is configured to be used where an external cable or a terminator is connected to a port. The specific circuitry within a device determines whether it is required at an unused external port.

SUMMARY OF INVENTION

Cover assemblies, capable of being locked and unlocked by means of a key, are configured to be placed over the connectors at each end of an external computer system cable. When these cover assemblies are locked in place, the cable o cannot be unplugged from the connector ports of the system devices. When these cover assemblies are unlocked, they can be removed from the cable, and the cable can then be unplugged from the connector ports.

A first type of cover assembly is designed to operate with a connector which is fastened in place in its plugged position by means of a pair of screws, while a second type of cover assembly is designed to operate with a connector which is fastened in place by means of a pair of rotatable wire bails. These cover assemblies may also be used to prevent access to connector ports to which cables are not attached by locking in place terminators commonly used on such ports, or by locking in place shells configured for this purpose, if such terminators are otherwise not required.

This invention is intended in particular for use on computer systems with cabled peripheral devices using the SCSI interface (Small Computer System Interface). The use of this interface presents special data security problems, since it is possible to activate file devices from remote units. In other words, for example, it is possible to disconnect a cable attaching a system unit to a remote file device, and then to use a separate computer unit to access data stored in both the system unit and the remote file device. Thus, while data security is otherwise achieved by locking the covers of units, it is also necessary to prevent access to any external port by removing the cables attaching various peripheral units. The present invention provides a means of locking and unlocking cable assemblies to system units and peripheral units.

Computer system units using the SCSI interface typically have provisions for cable connections with this interface, to both internal and external devices. Thus, it is likely that such a unit might be configured with an internal device using the interface and an external port to which no cable is connected. A peripheral device may have two or more external ports, cabled together with this interface, so that, in a typical configuration, one or more of these ports is empty. Depending on the specific circuits used, it may be necessary to connect to such an external port to which a cable is not attached, a terminating connector, or terminator, consisting of a connector with contacts configured to form electrical connections with various of the contacts in the external port and electrical elements, such as resistors, connected among various of these terminator contacts. Such a port with a terminator can be used to access data from the system by replacing the terminator with a cable to another device. The present novel concept provides a means for locking and unlocking terminators to external ports of system units and peripheral units.

It is to be expected that many system users will upgrade their systems by adding additional cables and peripheral devices, thereby replacing some terminators with cables. Such users will probably generally want to retain the security features provided by this invention when such upgrades occur. The present invention provides a locking system in which the same locking mechanism can be used both with terminators and with cables. Computer adapter (input/output) cards, cables, and peripheral devices using the SCSI interface are now available from IBM and from various other manufacturers. It is likely that many system users now using such hardware would like to have the security features provided by this invention. Such cables, for example are typically fitted with fastening devices for holding the cables in place on a unit, such as screws extending through the cable connector to be tightened into threaded holes in the external port, or pivotable wire bails extending outward from external port to operate in slots in tabs extending from the cable connector. The present invention provides a locking mechanism which can be added to standard systems and cables without requiring the modification of such systems and cables.

BRIEF DESCRIPTION OF THE DRAWING

In the Figures similar parts have been given similar designations.

DESCRIPTION OF THE PREFERRED EMBODIMENTS

Figure 1:
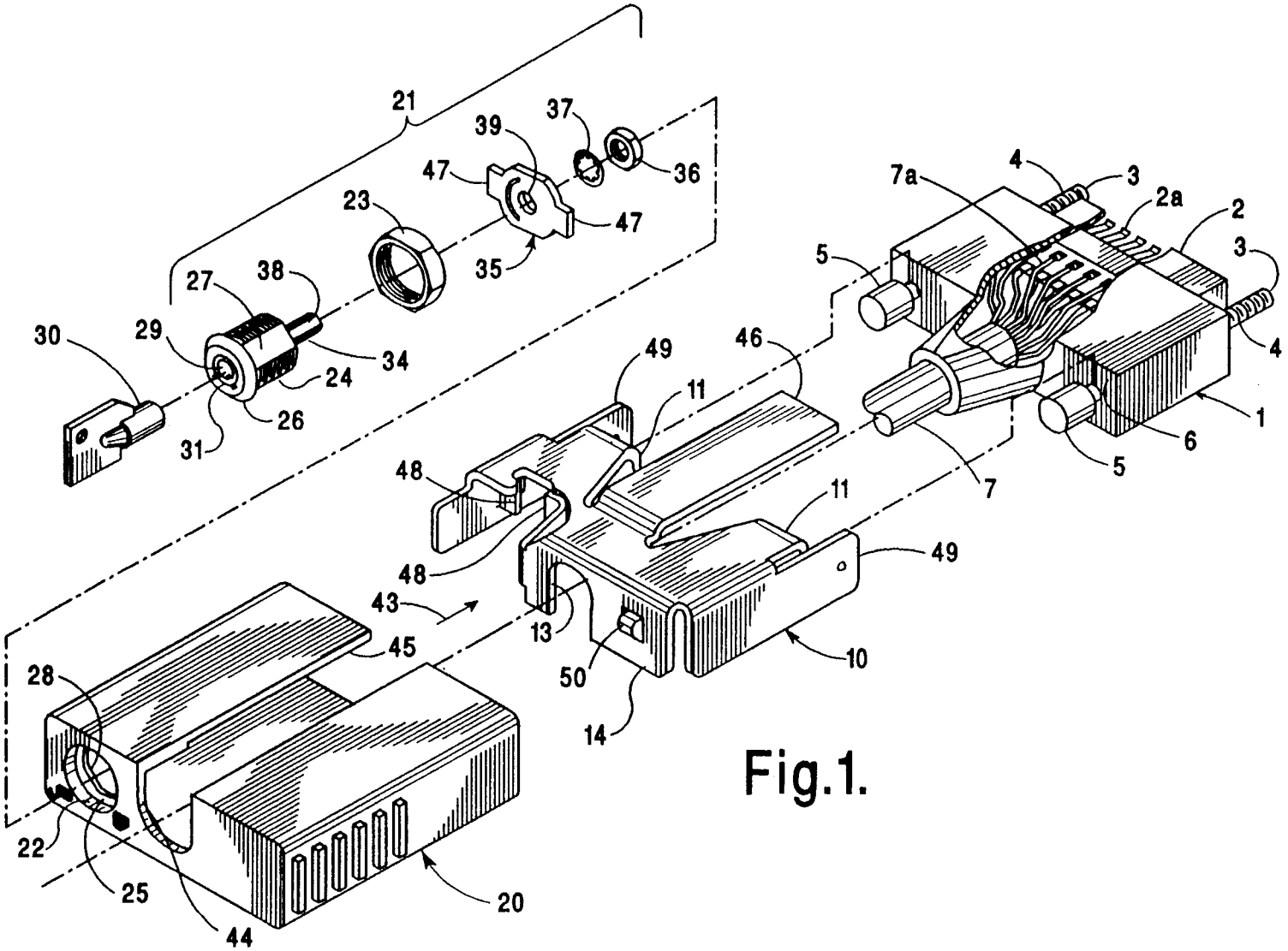
FIG. 1 exploded view of an embodiment of the present invention, which is adapted to lock a first type of cable connector in place on an external device port.

Several embodiments of this invention will now be discussed with respect to the Figures. The embodiment required will depend on the type of application and on the type of connector retention. Two types of applications are described herein first, the locking in place of a cable connector, including a contact face engaged with the port and a number of insulated wires, connected to contacts within the contact face, extending from a side of the connector opposite to this face; and second, the locking of a terminator, including a similar contact face and a number of electrical elements, such as resistors, interconnecting various contacts within this contact face. Two types of connector retention are also described herein, first, the attachment of the connector to the port by means of screws constrained to rotate within the connector housing, which are fastened into threaded holes at each side of the port; and second the attachment of the connector to the port by means of flexible wire bails rotatably mounted at each side of the port, operating in slots in tabs extending from each side of the connector. Both of these types of retention are in common use today, and both are applied both to cable connectors and to terminators. These types of retention hold the connectors in place, but, since they can be easily loosened, they do not provide the security provided by the invention disclosed herein.

The first embodiment of the present invention will now be discussed in reference to FIG. 1. The connector generally designated 1, to be locked in place by the device described herein, includes a contact shell 2, in which a number of contacts 2a (not shown) extend to be electrically and mechanically connected to contacts in a device port (not shown), and a pair of screws 3, with threaded portions 4 extending to engage threaded holes (not shown) adjacent to the device port and with screw heads 5 extending from the back surface 6 of connector 1. Screws 3 include shoulders (not shown), which operate on surfaces (not shown) within connector 1 to limit the axial motion of the screws relative to the connector while permitting their rotation. Thus, when the screws are fully engaged with the threaded holes adjacent to the device port, connector 1 is held in place attached to this port, and a gap remains between screw heads 5 and back surface 6 of the connector. Cable 7, which also extends from this back surface, contains various insulated wires 7a attached within connector 1 to contacts 2a.

Figure 2:
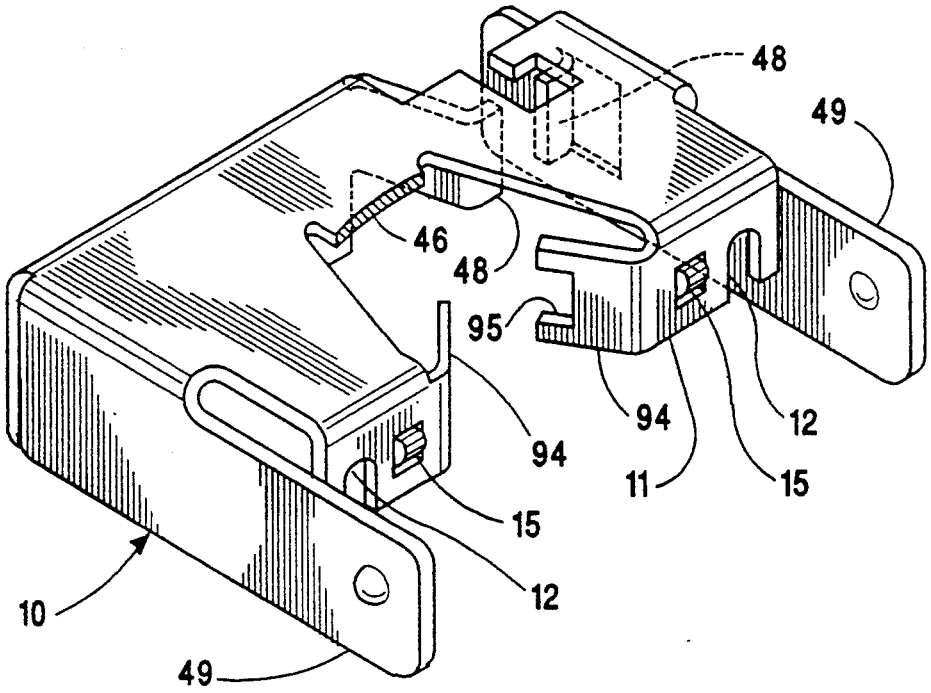
FIG. 2 is a perspective view of a bracket used in the first embodiment of the invention.

Referring to FIGS. 1 and 2, in the attachment of this connector locking assembly to connector 1, bracket generally designated 10 is first attached to the connector by sliding slotted tabs 11 downward adjacent to back surface 6 of the connector so that screws 3 extend through slots 12. The portions of tabs 11 adjacent to slots 12 move into the space between screw heads 5 and back surface 6 of the connector. Cable 7 then extends through cable slot 13 in back tab 14 of the bracket. Slotted tabs 11 also include a pair of formed springs 15, which operate on the adjacent part of the connector back surface 6 to prevent looseness between connector 1 and the installed bracket 10. Springs 15 are formed from a thin, flexible sheet of metal and are attached to the inside surface of bracket 10.

Referring to FIG. 1, cover generally designated 20 includes a lock assembly generally designated 21, which is held in place in hole 22 by nut 23 engaging threaded surface 24 to clamp cover flange 25 against lock flange 26. Rotation of lock assembly 21 in hole 22 is prevented by the operation of a flat 27 in threaded surface 24 on a flat 28 in cover flange 25. Rotor 29 of the lock assembly can be rotated when a properly encoded key 30 is inserted in slot 31. This rotor includes a threaded shaft 34 on which an interposer wheel 35 is held by means of nut 36 and lockwasher 37. The angular relationship between rotor 29 and interposer wheel 35 is maintained by the engagement of flats 38 of the threaded shaft on flats 39 of the hole in the interposer wheel.

The attachment of this connector locking assembly continues with the sliding of cover 20 in the direction of arrow 43 over bracket 10 as cable 7 slides in cable slot 44. As this motion occurs, the axial portion 45 of this slot is closed by tab 46 extending from bracket 10. This sliding motion can only be completed when lock rotor 29 is in its "unlocked" position, with interposer tabs 47 of interposer wheel 35 turned away from inward-facing locking tabs 48 of bracket 10. After the completion of this sliding motion, the key 30 is used to turn lock rotor 29 into its "locked" position so that subsequent removal of cover 20 is prevented by the engagement of locking tabs 48 with interposer tabs 47. Bracket 10 also includes a pair of support tabs 49, which can engage the internal surfaces of cover 20 to aid in its alignment as it is slid into place, and a formed spring 50, attached to the internal surfaces of the bracket, which pushes on the adjacent internal surface of cover 20 to prevent looseness when this cover is fully installed. When this attachment process is completed, key 30 is removed with lock rotor 29 in its "locked" position. Connector 1 cannot be removed from the device port because access to screws 3 is blocked by bracket 10 and by cover 20.

In order to remove connector 1 from the device port, this process must be reversed. First, the key 30 is inserted in slot 31, and lock rotor 29 is turned into its "unlocked" position. Then cover 20 is slid off bracket 10, in the direction opposite to that of arrow 43, and bracket 49 is slid upward from connector 1. At this point, screws 3 may be rotated to disengage connector 1 from the port.

Figure 3:
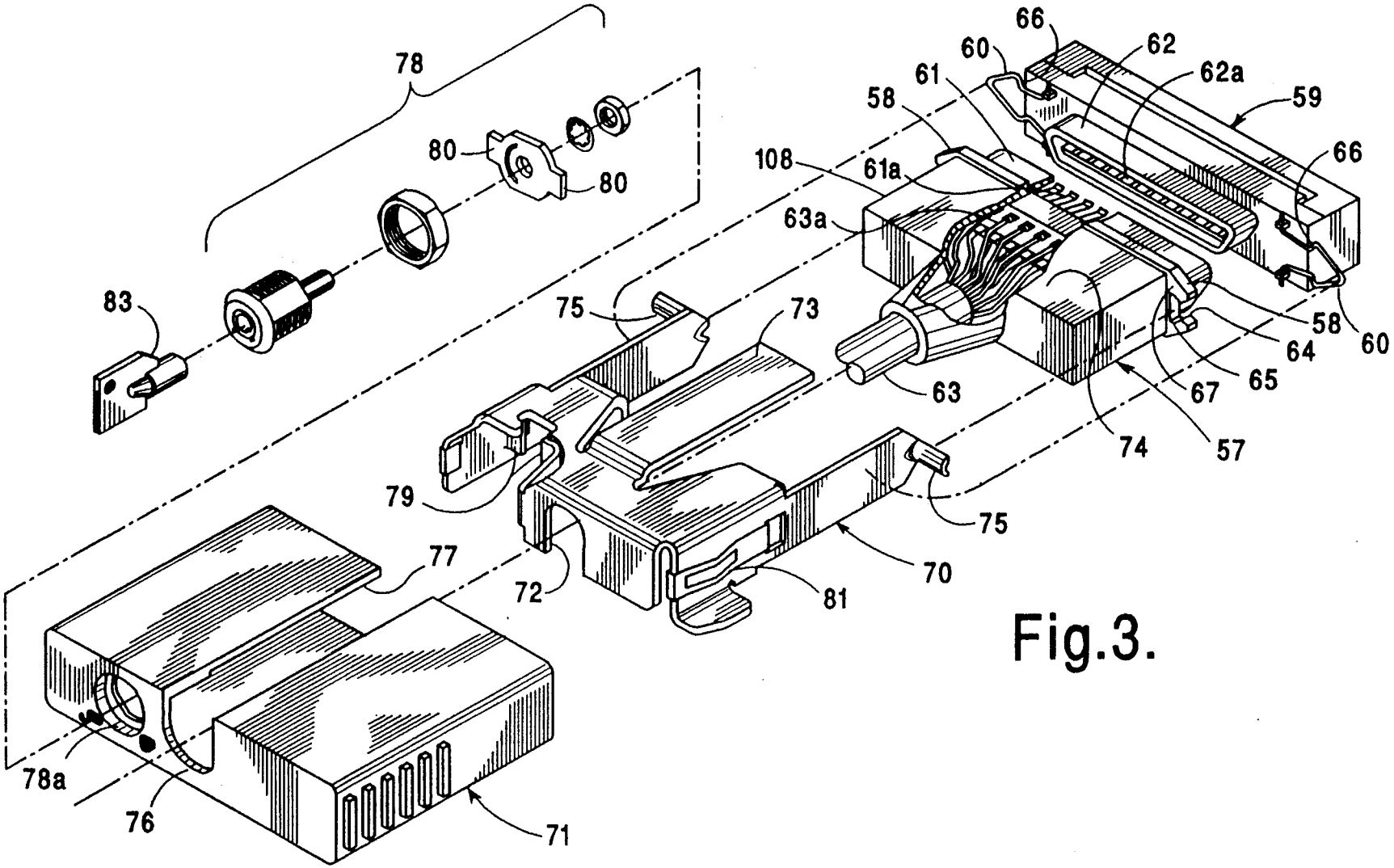
FIG. 3 an exploded view of a second embodiment of the invention, which is used to lock a second type of cable connector in place on an external device port.

The second embodiment of the invention will now be discussed in reference to FIG. 3. This embodiment is configured for locking a connector generally designated 57 having slotted tabs 58 in place over a device port 59 having attached rotatable bails 60. Connector 57 also includes a contact portion 61, in which contracts 61*a* make electrical connection with contacts 62*a* in contact portion 62 of device port 59. Contacts 61*a* of connector 57 are in turn connected to various individual insulated wires 62*a* extending within a cable 63. This connector 57 is latched in place by the inward rotation of rotatable bails 60. During the first part of this rotation, each bail is rotated through a narrowed portion 64 of the associated slot in slotted tabs 58, while during the final part of this rotation, the bail is rotated into a widened portion 65 of the slot. Each bail 60 is flexible to permit its passage through the narrowed portion 64 of the slot, while its subsequent expansion in the widened portion 65 of the slot helps to hold it in place. Each bail 60 includes a pair of latching surfaces 66 which lock the connector 57 in place by preventing the outward movement of adjacent tab surfaces 67. The connector can be unlatched for subsequent removal from device port 59 by reversing this procedure; after bails 60 are rotated outward, the connector may be pulled straight off port 59.

The connector locking assembly consists of a bracket generally designated 70, which is slid over the cable 63 and the connector 57, and a cover generally designated 71, which is locked in place over bracket 70. Bracket 70 includes an open slot 72, which is slid into place over the cable, an elongated tab 73, which is slid into place over the adjacent surface 74 of the connector, and a pair of formed locking tabs 75, which are moved into place adjacent to slotted tabs 58 of the connector. Cover 71 includes an open slot 76, which is slid over the cable 63, an elongated slot 77, which is slid into place around elongated tab 73 of bracket 70, and a rotatable lock mechanism generally designated 78, which is fastened into place in hole 78*a*. Locking mechanism 78 is similar or identical to that which has previously been described in reference to FIG. 1. Bracket 70 also includes a pair of locking tabs 79, one of which is shown in FIG. 3, which extend inwardly to engage adjacent tabs 80 of rotatable lock mechanism 78 when cover 71 is slid completely onto bracket 70. Opposed formed springs 81 welded to bracket 70, assure a snug fit between bracket 70 and cover 71 by operating on internal surfaces of cover 71.

In order to install and lock connector 57 with its cable 63 in place on device port 59, connector 57 is first plugged into the port. Then bracket 70 is slid into place over the connector and cable, and rotatable bails 60 are rotated inward into the slots in slotted tabs 58 of the connector and over formed locking tabs 75 of the bracket. Then cover 71 is slid into place over bracket 70, and rotatable lock mechanism 78 is rotated, using key 83, to lock the cover and bracket together by moving tabs 80 of the lock mechanism into place behind locking tabs 79 of bracket 70. At this point, connector 57 and cable 63 are locked in place by locking rotatable bails 60 in their inward positions over locking tabs 75 of the bracket.

In order subsequently to remove connector 57 with its cable 63 from device port 59, this procedure is reversed. First, rotatable lock mechanism 78 is rotated using key 83, so that tabs 80 clear locking tabs 79 of bracket 70, and cover 71 is slid off the bracket 70. Then rotatable bails 60 are rotated outward to clear formed locking tabs 75 of the bracket, and the bracket is slid off connector 57 and cable 63.

Connector 57 and cable 63 can now be unplugged from the device port. It is anticipated that the first and second embodiments of this invention will be supplied together, along with a common mateable key, for use on a presently-available cable assembly having a connector with retention screws, as described in reference to the first embodiment, at one end and a connector with slots for bail latches, as described in reference to the second embodiment, at the opposite end. These embodiments may also be supplied individually or in pairs of similar parts for different applications.

Certain circuits used with the SCSI interface require that a terminator block be attached to a connector, for proper operation, whenever no cable is attached. Such a terminator block includes a structure with electrical contacts and fastening hardware similar to that used in the connector end of a cable assembly. While wires do not extend from this structure in the form of an external cable, various electrical contacts within this structure are connected with electrical elements, such as resistors.

Figure 4:
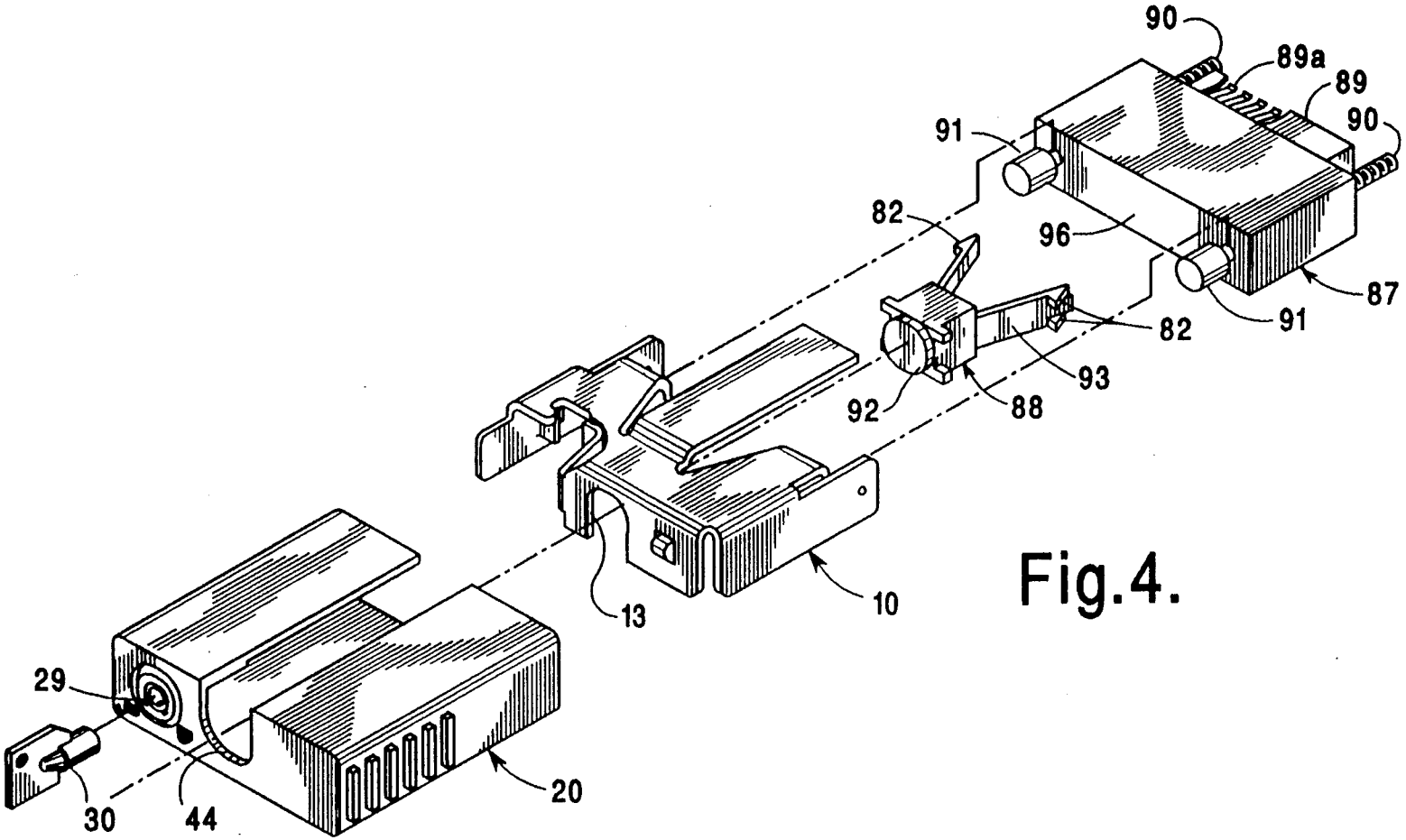
FIG. 4 is an exploded view of a third embodiment of the invention, which is used to lock a first type of terminator in place on an external device port.

Referring to FIG. 4, a first type of lockable terminator assembly, which is a third embodiment of this invention, consists of a bracket generally designated 10 and a cover generally designated 20, which are identical to these parts as described above in reference to FIG. 1; of terminator generally designated 87, and of filler block generally designated 88, a plastic part which is used to fill cable slot 44 of cover 20. Terminator 87 includes a contact shell 89 in which a number of contacts 89*a* extend to be electrically and mechanically connected to the contacts of an external device port (not shown)on a, e.g., personal computer. At least some of these contacts are interconnected with electrical elements, such as resistors. This terminator also includes a pair of screws 90 with screw heads 91, which operate like screws 3 with screw heads 5,as described above in reference to FIG. 1, to hold terminator 87 removably engaged with the external device port. Filler block 88 includes a rounded portion 92, which, upon assembly of the entire locking mechanism, blocks access through the aperture formed by rounded cable slot surfaces 13 and 44 of bracket 10 and cover 20, respectively, to the area within this bracket. Filler block 88 also includes elongated tabs 93, which extend away from rounded portion 92 to end in mounting tabs 82. Referring to FIG. 2, bracket 10 includes a pair of inward formed tabs 94, which in turn include aperture slots 95. When filler block 88 is placed into the space between these inward-formed tabs 94, with rounded portion 92 blocking access through cable slot 13, these mounting tabs fit into aperture slots 95, holding bracket 10 and filler block 88 in alignment.

Referring to FIG. 4, this type of lockable terminator assembly may be assembled by first engaging contact shell 89 of terminator 87, and the contacts 89*a* therein with an external machine port (not shown), rotating screws 90 in threaded holes (not shown) of the port. Filler block 88 is then inserted into bracket 10, into the position described above wherein elongated tabs 93 lie between inward-formed tabs 94 of the bracket. This combination of bracket 10 and filler block 92 is then assembled on terminator 87 by sliding slots 12 in slotted tabs 11 (shown in FIG. 2) of bracket 10 over screws 90 so that these tabs are between screw heads 91 and the adjacent surface 96 of the terminator. Cover 20 is then slid onto bracket 1 by sliding the edges of elongated slot 45 over the edges of elongated tab 46 and is locked in place, as described in reference to FIG. 1, by rotating lock assembly rotor 29 with key 30.

Figure 5:
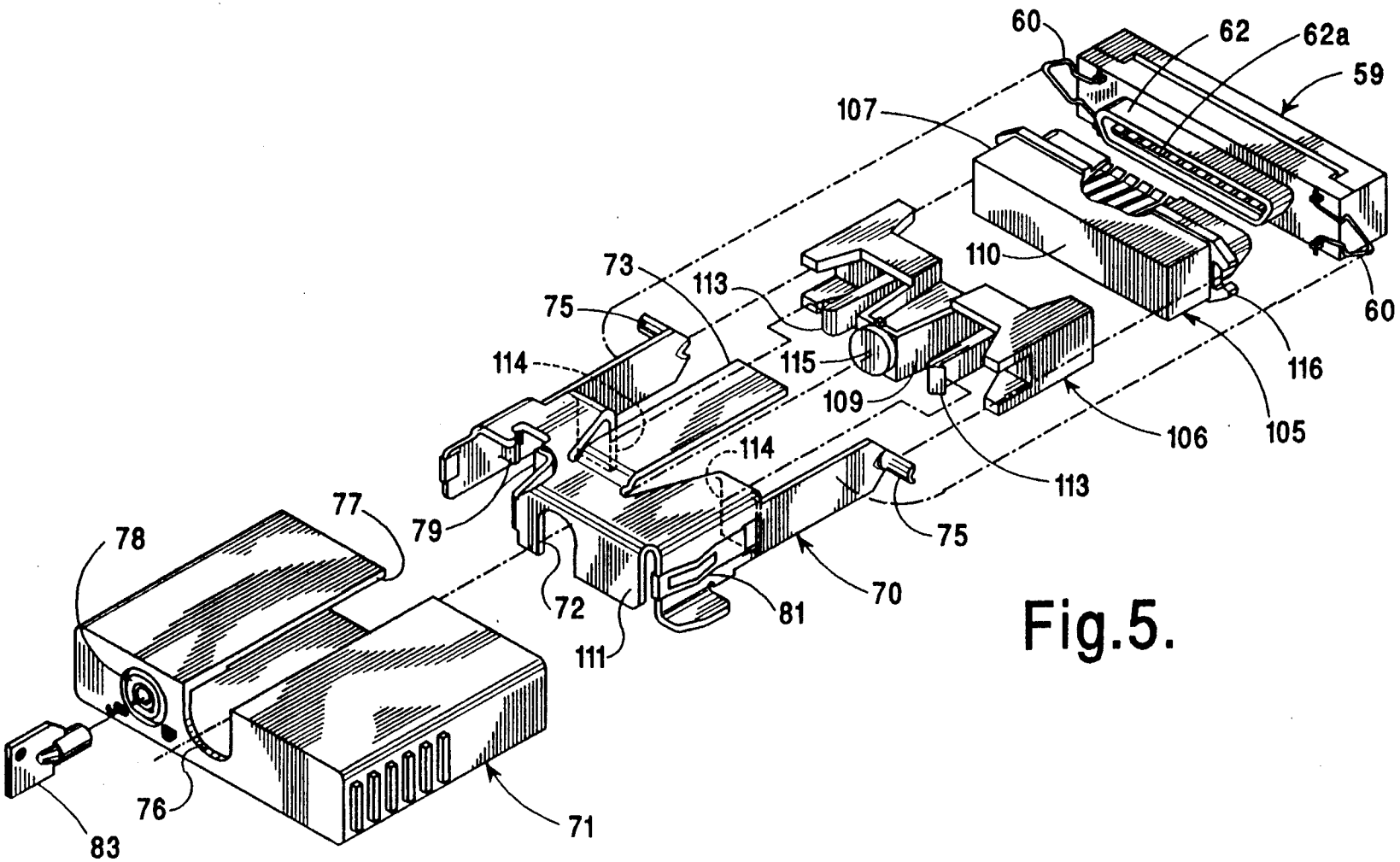
FIG. 5 view is an exploded view of a fourth embodiment of the invention, which is used to lock a second type of terminator in place on an external device port.

This type of assembly may subsequently be disassembled by essentially reversing the process described above. Rotor 29 is returned to its unlocked position, using key 29, cover 20 is slid off bracket 10, slotted tabs 11 of the bracket are slid out of the area between screw heads 91 and adjacent terminator surface 96, and screws 90 are turned to loosen terminator 87 from the external machine port (not shown). Referring now to FIG. 5, a second type of lockable terminator assembly, which is a fourth embodiment of this invention, is used to lock a second type of terminator, generally designated 105, to a device port, generally designated 59. This lockable terminator assembly includes a second type of filler block generally designated 106, a bracket 70 and a cover 71. Device port 59, bracket 70, and cover 71 may be identical to these parts as previously described in reference to FIG. 3. The housing portion 107 of terminator 105 is shorter than the housing portion 108 of connector 57 in FIG. 3, so filler block 106 includes an extended portion 109, which fills space between the outer surface 110 of terminator 105 and the inner surface of front tab 111 of bracket 70. Filler block 106 also includes flexible latches 113, which operate on latching tabs 114 of bracket 70 to hold filler block 106 and bracket 70 engaged in an orientation wherein rounded portion 115 of the filler block 106 prohibits access to the interior of the bracket through the hole formed by rounded cable slots 72 and 76 of bracket 70 and of cover 71, respectively. This type of lockable terminator assembly may be assembled by first sliding filler block 106 into bracket 70 so that flexible latches 113 are latched in place on the corresponding tabs 114 of bracket 70, and by engaging terminator 105 with device port 59. The assembly of bracket 70 and filler block 106 is then placed over terminator 105, and bails 60 are rotated into a latched position, in which they latch slotted tabs 116 of terminator 105 in place, and in which formed locking tabs 75 of bracket 70 are captured by the looped portion of bails 60. Cover 71 is then slid into place over bracket 70, with elongated tab 73 filling the space of elongated slot 77, and this cover is locked in place by turning rotatable lock mechanism 78 with key 83.

This type of assembly may subsequently be disassembled by essentially reversing this procedure. Lock mechanism 78 is returned to an unlocked position using key 83, cover 71 is slid off bracket 70, and bails 60 are rotated outward so that bracket 70 and terminator 105 can be separated and removed from device port 59. Flexible latches 113 are then depressed inward so that bracket 70 and filler block 106 can be separated. Some SCSI circuits do not require the use of terminators at exit ports to which cables are not attached. For such circuits, data security may be achieved by using further embodiments of this invention, which are identical to those described in reference to FIGS. 4 and 5, except that terminators 87 and 105 are replaced with shells without contacts and other electrical components. Thus, these shells can be locked in place by the hardware as described above.

It is evident that further modifications of this invention can be devised by those skilled in the relevant arts. For example, this invention could be used to cover the latch release buttons of a connector having pivotable latches operable with hooks extending from the external device port.

What is claimed is:

1. Apparatus for locking a cable connector in engagement with an external port of a device, wherein said cable connector comprises a plurality of electrical contacts at a contact end configured for contact with port contacts within said external port and a plurality of insulated wires attached to various of said electrical contacts extending from said cable connector at an end opposite said contact end, wherein said cable connector and said port include first attachment means for holding said cable in engagement with said port, said first attachment means being operable to prevent said cable connector from being pulled away from said port and to release said cable connector for disengagement with said port, wherein said first attachment means comprises a screw rotatable in said cable connector and engageable within a threaded hole in a port, with a screw head attached thereto extending from an end of said cable connector opposite to said contact end, and wherein said apparatus comprises:

a bracket configured for engagement with said connector, including a bracket aperture through which said insulated wires extend when said bracket and said connector are so engaged;

second attachment means for holding said bracket and said connector in engagement, wherein said second attachment means comprises a tab, including a slot, extending from said bracket, configured so that, when said bracket is engaged with said cable connector, surfaces adjacent to said slot extend between said screw head and an adjacent back face opposite to a front face of said cable connector;

a cover configured for engagement with said bracket, including a cover aperture through which said insulated wires extend when said cover is engaged with said bracket and said bracket is engaged with said connector; and lockable attachment means for holding said cover and said bracket in engagement;

wherein said cover, engaged with said bracket, surrounds said second attachment means when said bracket is engaged with said cable connector, to block access thereto;

wherein said cover and said bracket, when engaged with each other and with said connector, block operation of said first attachment means, thereby preventing release of said cable connector from said port; and wherein said cover and said bracket together comprise means for surrounding said screw head to block access thereto when attached and engaged with said connector.

2. Apparatus for preventing electrical and mechanical access to contacts within an external port of a device, wherein said apparatus comprises:

a connector engageable with said port, configured to block access to said contacts;

first attachment means for holding said connector in engagement with said port, wherein said first attachment means includes a screw constrained to rotate within a hole in said connector, operable within a threaded hole in said port;

a bracket engageable with said connector, wherein said bracket, when so engaged, partially surrounds said connector;

second attachment means for holding said bracket in engagement with said connector, wherein said second attachment means includes a slotted tab in said bracket, positioned over a portion of said screw between a head of said screw and an adjacent back face opposite to a front face of said connector;

a cover engageable with said bracket, wherein, when said bracket is engaged with said connector and said cover is engaged with said bracket, said bracket and said cover surround said connector prohibiting access to said first and second attachment means; and lockable attachment means for holding said cover in engagement with said bracket.

* * * * *